US005931698A

United States Patent [19]

Kodama

[11] Patent Number: 5,931,698

[45] Date of Patent: Aug. 3, 1999

[54] SHIELDED WIRE CONNECTION DEVICE

[75] Inventor: Shinji Kodama, Shizuoka-ken, Japan

[73] Assignee: Yazaki Corporation, Tokyo, Japan

[21] Appl. No.: 08/941,702

[22] Filed: Oct. 1, 1997

[51] Int. Cl.[6] ..... H01R 9/05

[52] U.S. Cl. ..... 439/578

[58] Field of Search ..... 174/51; 439/98, 439/610, 578, 92

[56] References Cited

U.S. PATENT DOCUMENTS 5,460,544 10/1995 Inaba et al. ..... 439/578

*Primary Examiner*—Gary F. Paumen
*Assistant Examiner*—Alexander Gilman
*Attorney, Agent, or Firm*—Oblon, Spivak, McClelland, Maier & Neustadt, P.C.

[57] ABSTRACT

A signal transmitting core wire and a shielding braid of a shielded wire are connected to a signal line and a shield line, respectively, by combination of a solderless terminal attached to the core wire, an insulating inner housing accommodating a stripped terminal portion of the shielded wire including the solderless terminal, an insulating outer housing accommodating the inner housing, a signal terminal provided through the inner and outer housings for connection to the signal line and contact with the solderless terminal, and a resilient shield terminal provided through the outer housing for connection to the shield line and extending between the inner and outer housings for a concurrent contact with a circumferential region of the braid that the shield terminal makes at a flat or arcuate contact part slipping in a slit formed through the inner housing.

12 Claims, 9 Drawing Sheets

SHIELDED WIRE CONNECTION DEVICE

BACKGROUND OF THE INVENTION

1. Field of the Invention

The present invention generally relates to a shielded wire connection device, and particularly, it relates to a connection device for a shielded wire with an electromagentic shield function.

2. Description of Relevant Art

FIGS. 1A to 1C serially illustrate processes of a conventional measure for connecting an electromagnetically shielded wire.

In the figures, designated at reference character 1 is the shielded wire. The wire 1 is comprised of a pair of core wires 2 for transmitting electric signals, an inner insulator 3 covering the core wires 2, a braid 4 as a net of braided shield wires wrapped around a filler on the inner insulator 3 for electromagnetically shielding the inside from outside, and a protective outer insulator 5 covering the braid 4.

In an initial process shown in FIG. 1A, the shielded wire 1 is stripped of an adequate terminal length of the outer insulator 5, exposing a corresponding part of the braid 4, which is twisted into a strand 6 to be connected to one end of a shield interconnection wire 7. After removal of the inner insulator 3, a total of three solderless terminals 8 are applied: two, to ends of the core wires 2; and the remaining one, to the other end of the shield interconnection wire 7.

In a subsequent process shown in FIG. 1B, the strand 6 of the braid 4 is folded back on a non-stripped end of the shielded wire 1, and a tubular cap 9 is put thereover, separating the strand 6 from the core wires 2 to prevent an occasional contact, arranging contact ends of the terminals 8 at a distance.

In a final process shown in FIG. 1C, the three terminals 8 are connected to mating terminals of unshown opponent appliances by a connector 10 of which a housing is formed with an array of accommodation chambers 11. A respective terminal 8 is inserted from ahead into one accommodation chamber 11, where it conductively engages with a corresponding mating terminal fitted therein from behind.

In the conventional measure, the braid 4 is stripped from around the inner insulator 3, collected and twisted into the strand 6, and connected to the one end of the shield interconnection wire 7 by a sleeve as a repeating terminal element to be pressed flat for clamping. The braid 4 thus needs a troublesome termination with many working steps.

Further, the other end of the shield interconneciton wire 7 also is connected to one solderless terminal 8 by a clamping. Number of component parts and that of working steps are the more increased, respectively, resulting in an inefficient connection.

Particularly, in application to an electric junction box associated with a multiplicity of shielded wires, such as in an automobile, the conventional measure takes a long time and significantly troublesome in connection of the shielded wires.

SUMMARY OF THE INVENTION

The present invention has been achieved with such points in view.

It therefore is an object of the present invention to provide a device for connecting a shielded wire with an improved braid termination, a reduced number of component parts, such as of solderless terminals, and a reduced number of working steps, permitting a facilitated connection.

To achieve the object, a first aspect of the present invention provides a connection device for connecting a shielded wire (20) to a combination of a signal line and a shield line, the shielded wire (20) having a stripped terminal portion (20*a*) including a braid (23) wound around an inner insulator (22) put on a core wire (21) and a terminal member (25) attached to the core wire (21), the connection device comprising an insulating first housing (34) for having the terminal portion (20*a*) of the shielded wire inserted therein, an insulating second housing (42; 62) for having the first housing (34) inserted therein, a first terminal (41) contacting at one end thereof with the terminal member (25) and connected at another end thereof to the signal line, the first terminal (41) being provided through the first (34) and the second housing (42; 62), and a second terminal (43; 51; 52) contacting at one end (45) thereof with the braid (23) and connected at another end thereof to the shield line, the second terminal (43; 51; 52) being provided through the second housing (42; 62) and extending between the first (34) and the second housing (42; 62).

According to the first aspect, a signal transmitting core wire and a shielding braid of a shielded wire are connected to a signal line and a shield line, respectively, by a combination of a terminal member, an insulating first housing accommodating therein a stripped terminal portion of the shielded wire including the terminal member attached to the core wire, an insulating second housing accommodating therein the first housing, a first terminal provided through the first and the second housing for connection to the signal line and a concurrent contact with the terminal member, and a second terminal provided through the second housing for connection to the shield line and a concurrent contact with the braid that is achieved by a portion of the second terminal extending between the first and the second housing and contacting on a region of the braid that may be exposed through or outside the first housing.

Accordingly, there is eliminated a conventional interconnection wire (7) with an associated terminal fitting. Moreover, the braid of the stripped terminal portion of shielded wire is left, as it is wound around an inner insulator, without being twisted.

According to a second aspect of the invention depending from the first aspect, the second terminal (43; 51; 52) has a contact part (45; 51*a;* 52*a*) resiliently contacting with a circumferential region (23*b*) of the braid (23).

According to the second aspect, a resiliently acting contact part of the second terminal cooperates with a circumferential region of the braid to permit a secured contact.

According to a third aspect of the invention depending from the second aspect, the second terminal (43) has a bent part (43*b,* 43*d*) disposed outside the first housing (34) for providing an increased resiliency to the contact part (45).

According to the third aspect, the second terminal that is inherently resilient has an increased resiliency.

According to a fourth aspect of the invention depending from the third aspect, the second housing (42) is formed with an opening (46) facing the bent part (43*b,* 43*d*) of the second terminal (43).

According to the fourth aspect, an opening of the second housing allows for a flexible resilient action of a bent part of the second terminal, with a minimized gap between the first and the second housing.

According to a fifth aspect of the invention depending from the second aspect, the circumferential region (23*b*) of the braid (23) is exposed outside the first housing (34).

According to the fifth aspect, the contact part of the second terminal is brought into contact with an exposed circumferential region of the braid from around an edge of the first housing that may be recessed.

According to a sixth aspect of the invention depending from the second aspect, the first housing (34) is formed with a slit (33, 35) for having the contact part (45) of the second terminal (43) slip therein to contact with the circumferential region (23*b*) of the braid (23).

According to the sixth aspect, the contact part of the second terminal is brought into a resilient contact with the circumferential region of the braid, through a slit formed in the first housing, when the first housing is inserted in the second housing.

According a seventh aspect of the invention depending from the sixth aspect, the first housing (34) has a pair of the slits (35) formed either in two of four lateral sides thereof opposing each other, the connection device (FIG. 7) has a pair of the contact parts (52*a*) disposed either on the two lateral sides of the first housing (34), and the pair of contact parts (52*a*) each have a contact surface extending in a tangential direction of the circumferential region (23*b*) of the braid (23).

According to the seventh aspect, a pair of contact parts are contacted to the braid from both sides. The contact parts are disposed either on two lateral sides of the first housing, as this housing is inserted in the second housing. The contact parts have their contact surfaces tangentially extending with respect to the circumferential region of the braid, permitting a secured contact even when the shielded wire is displaced toward either of the remaining two lateral sides of the first housing. The paired contact parts may preferably be joined together at their base ends.

According to an eighth aspect of the invention depending from the sixth aspect, the first housing (34) has a triple of the slits (35) formed any in three of four lateral sides thereof, and the connection device (FIG. 5) has a triple of the contact parts (52*a*) disposed any on the three lateral sides of the first housing (34).

According to the eighth aspect, a triple of contact parts are contacted to the braid from three of four sides, permitting a secured contact even when the shielded wire is displaced toward the remaining side. The contact parts are disposed on three lateral sides of the first housing, as this housing is inserted in the second housing. The triple of contact parts may preferably be joined together at their base ends.

According to a ninth aspect of the invention depending from the second aspect, the second housing (42) has a guide part (53) for guiding the first housing (34) to be inserted therein.

According to the ninth aspect, a guide part permits the first housing to be introduced in position for a smooth sliding contact with the contact part of the second terminal resiliently acting thereon.

According to a tenth aspect of the invention depending from the ninth aspect, the guide part (53) comprises an extension (L) of the second housing (42) extending past the contact part (51*a*) of the second terminal (51).

According to the tenth aspect, the guide part is directly connected to an accommodation portion of the second housing where the first housing is to be inserted. A smooth straight insertion is ensured with a guided entry continuously followed by a resilient positioning.

According to an eleventh aspect of the invention depending from the second aspect, the contact part (51*a;* 52*a*) has an arcuate contact surface.

According to the eleventh aspect, an arcuate contact surface of the contact part ensures a smooth sliding with the first housing, when this housing is inserted in the second housing.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIGS. 1A to 1C serially illustrate processes of a conventional measure for connecting a shielded wire;

DETAILED DESCRIPTION OF THE PREFERRED EMBODIMENTS

Figure 1A:
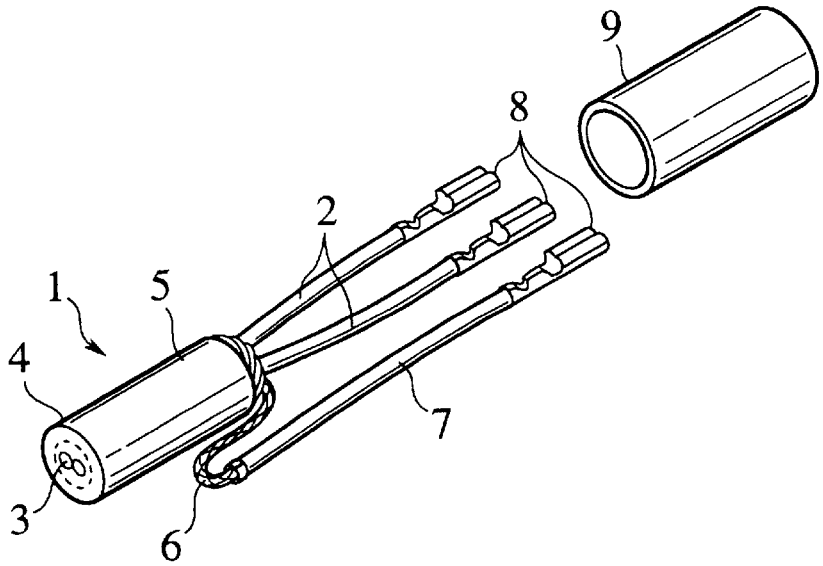
FIG.1A PRIOR ART
Figure 1B:
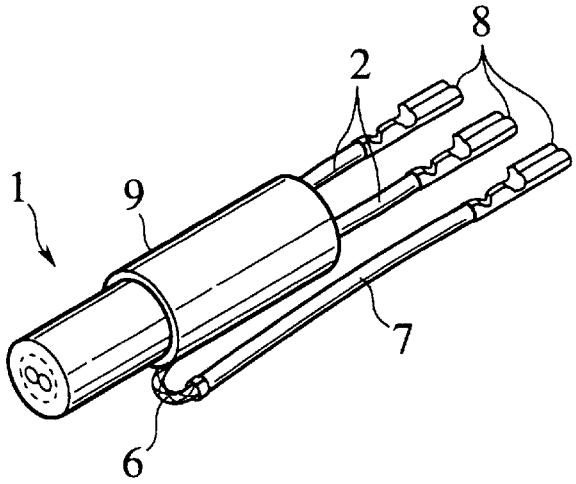
FIG.1B PRIOR ART
Figure 1C:
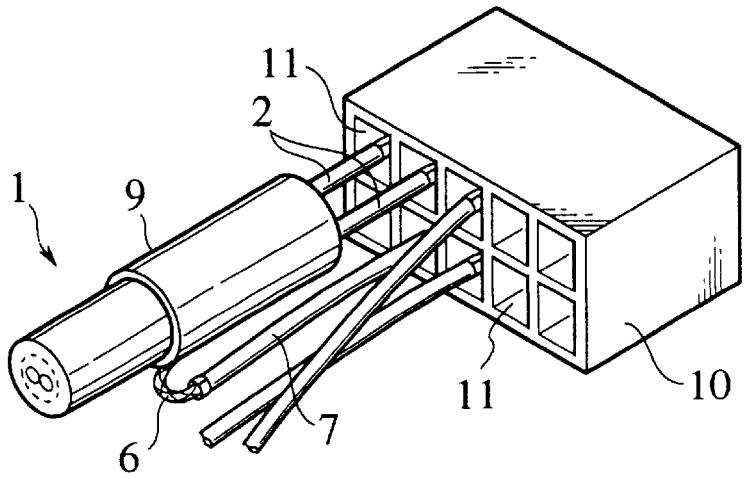
FIG.1C PRIOR ART

There will be detailed below the preferred embodiments of the present invention with reference to the accompanying drawings. Like members are designated by like reference characters.

Figure 2:
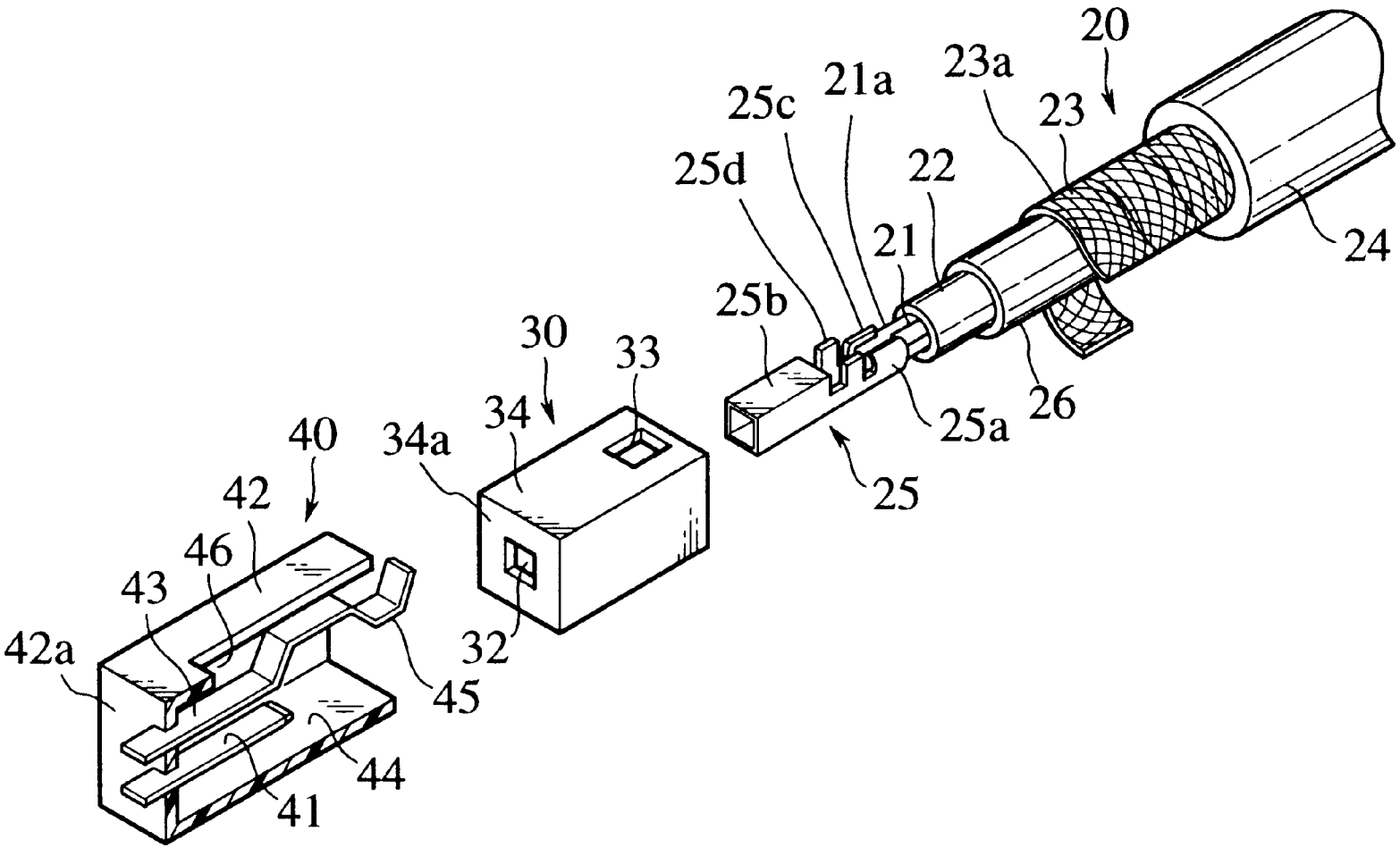
FIG. 2 is an exploded view of a shielded wire connection device according to an embodiment of the invention.
Figure 3:
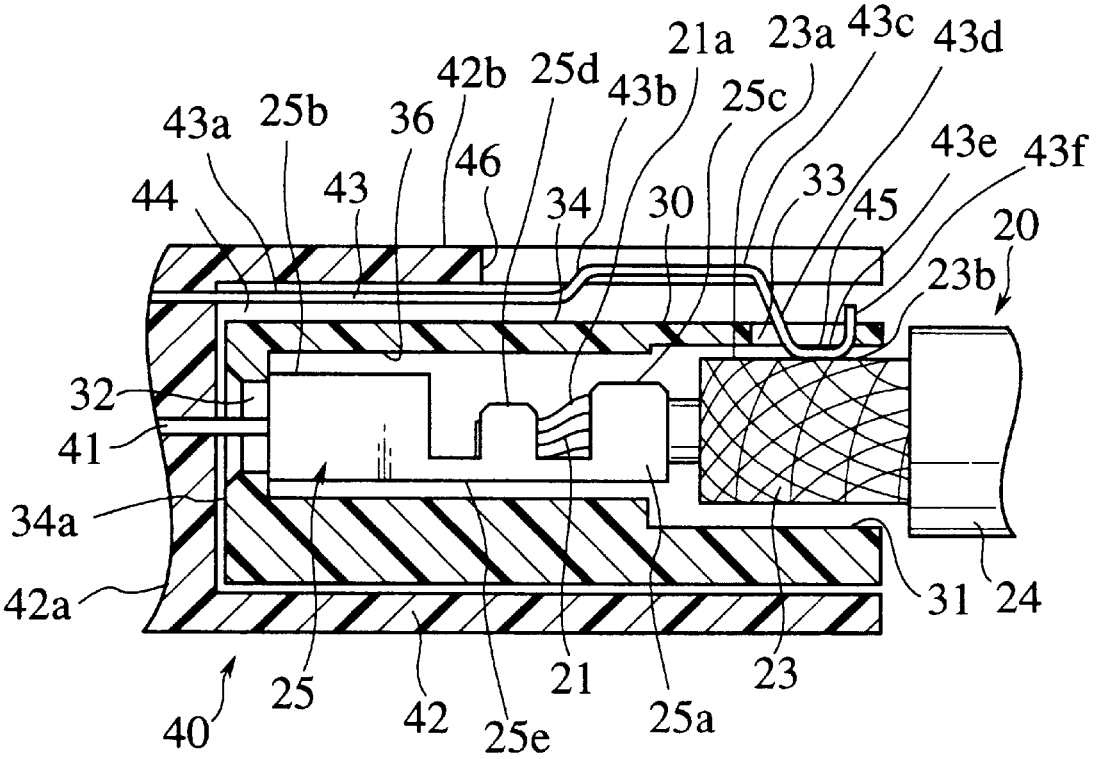
FIG. 3 is a longitudinal section of the device of FIG. 2.

FIG. 2 is an exploded view of a connection device for connecting a shielded wire according to a first embodiment of the invention, and FIG. 3, a longitudinal section of the device. The connection device according to the first embodiment comprises a solderless terminal 25 applied to a shielded wire 20, a first connector 30 for accommodating therein the terminal 25 together with a stripped end of the shielded wire 20, and a second connector 40 for accommodating therein the first connector 30, getting a contact with a braid 23 of the shielded wire 20.

The shielded wire 20 includes a core wire 21 as a signal line consisting of a plurality of element wires of a diameter, an inner insulator 22 covering the core wire 21, a braid 23 as a net of braided shield wires wrapped or wound around a filler 26 on the inner insulator 22, and a protective outer insulator 24 covering the braid 23. For connection, the shielded wire 20 is stepwise stripped to have a terminal part 21*a* of the core wire 21 and a terminal part 23*a* of the braid 23 both exposed. The terminal part 23*a* of braid 23 wound around the inner insulator 22 is left exposed, without being twisted nor without connection to a shield interconnection wire or application of a terminal fitting.

On the other hand, the terminal part 21*a* of core wire 21 has the solderless terminal 25 applied thereto. The solderless terminal 25 comprises: an electric wire holding portion 25*a* having a clamp part 25*c* as an insulator holding part for clamping the core wire 21 from outside the inner insulator 22 and a contact part 25*d* as a conductor holding part for directly clamping the core wire 21; and a square tubular terminal portion 25*b* integrally formed at an end of the wire holding portion 25*a*. The terminal 25 is formed by folding a single cut piece of a conductive sheet, and has a straightly extending flat bottom wall 25*e* of which a rear part constitutes a bottom side of the holding portion 25*a* and a front part constitutes a bottom side of the terminal portion 25*b*. The core wire 21 is put on the rear part of the bottom wall 25*e* and clamped in position by the holding portion 25*a*, permitting a secured electrical contact.

The first connector 30 comprises a square tubular housing 34 having a front wall 34*a*. The housing 34 is formed as an insulating resin mold with: a terminal accommodation chamber 36 for accommodating therein an entirety of the solderless terminal 25; and a rearwardly opening insert entrance 31 for loose-fitting on the terminal part 23*a* of braid 23, as it is wholly introduced therein when the terminal 25 is inserted in the accommodation chamber 36 to an end. The front wall 34*a* of housing 34 has a central connection opening 32 formed therethrough for allowing a later-described signal terminal 41 of the second connector 40 to enter the terminal accommodation chamber 36. The chamber 36 and entrance 31 of the housing 34 have a sufficient total length to cover a total length of the stripped part of shielded wire 20 and the solderless terminal 25 applied thereto.

A rear upper part of the housing 34 of first connector 30 has a rectangular window 33 opened therethrough in position to face an upper intermediate region 23*b* of the terminal part 23*a* of braid 23, as it is inserted in the rear entrance 31.

The second connector 40 comprises a square tubular housing 42 closed at a front end with a wall 42*a*, and a pair of terminals 41, 43 provided through the front wall 42*a*, i.e. a signal terminal 41 and a shield terminal 43. The housing 42 is configured to be adaptive for a mating with an unshown opponent member to which the shielded wire 20 is finally connected. For example, the front wall 42*a* has a flat outside to be mounted on a wiring board of the opponent member, where front projecting ends of the signal and shield terminals 41, 43 are inserted. In the housing 42 is defined a terminal accommodation chamber 44 for accommodating therein an entirety of the first connector 30. The signal and shield terminals 41, 43 extend in the accommodation chamber 44 substantially in a horizontally rearward direction.

The shield terminal 43 has a base part 43*a* rearwardly extending from an upper-most region of the front wall 42*a* of housing 42, an inclined part 43*b* ascending from a rear end of the base part 43*a*, a flat top part 43*c* rearwardly extending from an upper end of the inclined part 43*b*, a declined part 43*d* descending from a rear end of the top part 43*c*, a flat bottom part 43*e* rearwardly extending from a lower end of the declined part 43*d*, and an upwardly bent end 43*f*. The flat bottom part 43*e* constitutes a contact portion 45 of the shield terminal 43 relative to the upper intermediate region 23*b* of the terminal part 23*a* of braid 23, and may preferably be arcuate in section. The inclined and declined parts 43*b*, 43*d* serve to provide the contact portion 45 with an increased resiliency against the braid 23. As the contact portion 45 is put on the braid 23, the flat top part 43*c* is wholly located within a longitudinal groove 46 formed through an upper wall 42*b* of the housing 42.

More specifically, when the first connector 30 with the shielded wire 20 terminated therein is inserted to be fitted in the terminal accommodation chamber 44 of the second connector 40 to an end, the contact portion 45 of shield terminal 43 slips through the window 33 into the rear entrance 31 of the first connector 30, getting a resilient surfacial contact with the braid 23, permitting a secured electrical conduction therebetween. As the first connector 30 is inserted in the terminal accommodation chamber 44 of the second connector 40 to the end, the signal terminal 41 passes the connection opening 32 and enters the terminal accommodation chamber 36 of the first connector 30, where it engagingly contacts with the terminal portion 25*b* of the solderless terminal 25 and is connected to the core wire 21 of the shielded wire 20.

In the present embodiment, the braid 23 of shielded wire 20 is left, as it is stripped for termination, without being peeled from the inner insulator 22 or twisted, thus eliminating conventional troublesome termination steps. It also is unnecessary to apply a repeating terminal to the braid 23, permitting a secured connection with a reduced number of such terminal fittings, resulting in a facilitated connection of shielded wire 20 taking a shorter time.

In the embodiment, the first connector 30 is formed with the window 33 to permit the shield terminal 43 to contact with the braid 23 of shielded wire 20. However, the braid 23 may have a stripped region thereof left exposed outside a housing of a first connector, for a direct contact with the shield terminal 43, without the need of a window formed in the connector housing, thus permitting a facilitated molding of connector housing.

Figure 4:
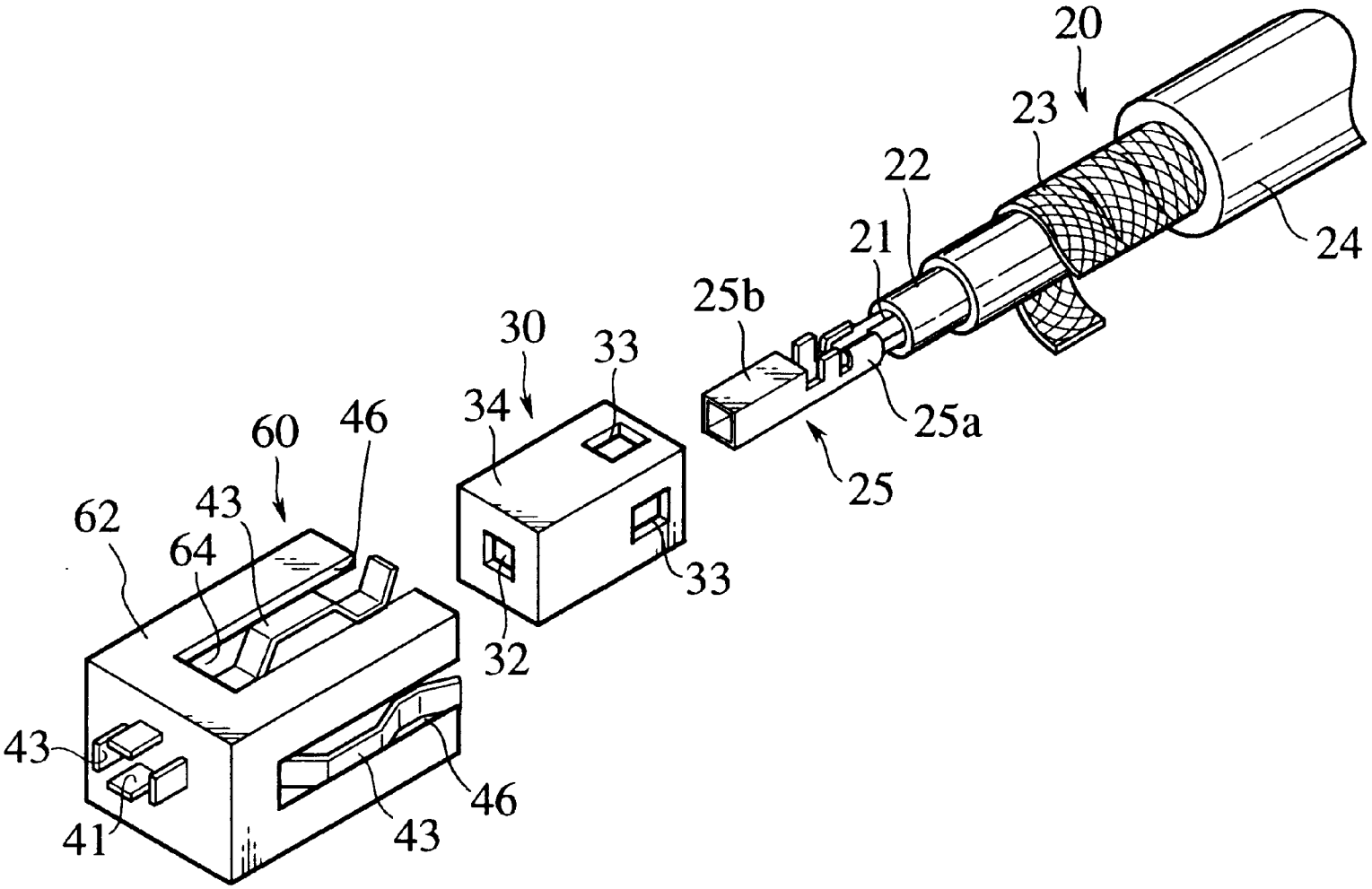
FIG. 4 is an exploded view of a shielded wire connection device according to another embodiment of the invention.

FIG. 4 shows a shielded wire connection device according to a second embodiment of the invention.

In the second embodiment, a housing 34 of a first connector 30 is formed with left, right and upper windows 33, and a second connector 60 has a triple of left, right and upper shield terminals 43 rearwardly extending in a terminal accommodation chamber 64 of the connector 60 of which a housing 62 is formed with left, right and upper longitudinal grooves 46.

When the first connector 30 is inserted in the second connector 60, the left, right and upper shield terminals 43 contact at their contact portions with left, right and upper regions of a braid 23, through the left, right and upper windows 33, respectively.

The shield terminals 43 may preferably be joined at their base ends in a single conductive member provided through the housing 62.

Figure 5:
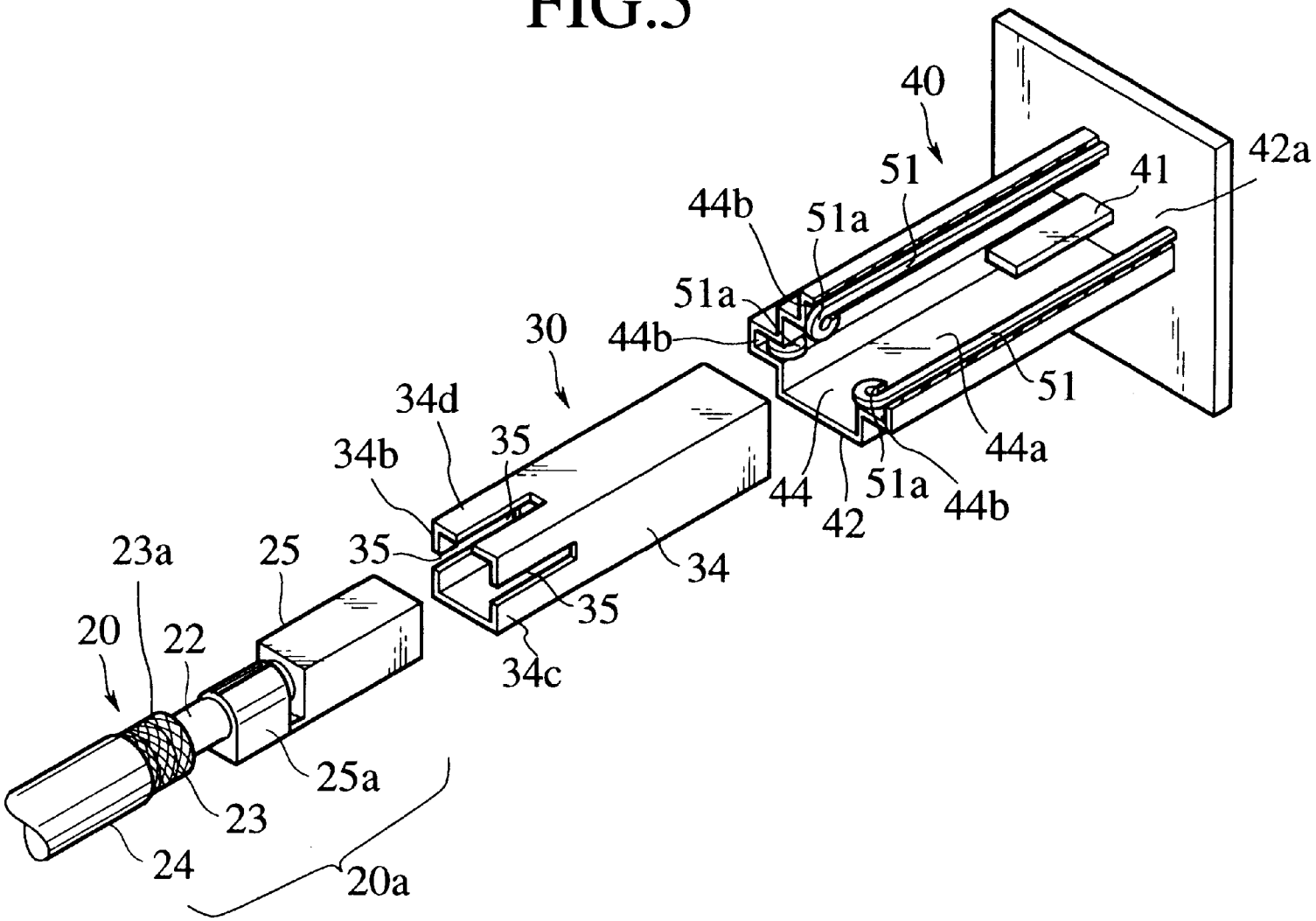
FIG. 5 is an exploded view of a shielded wire connection device according to another embodiment of the invention.
Figure 6A:
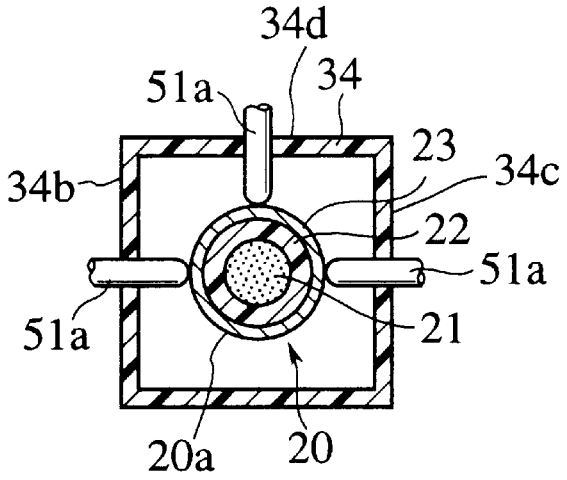
FIGS. 6A to 6C illustrate functions of the device of FIG. 5.
Figure 6B:
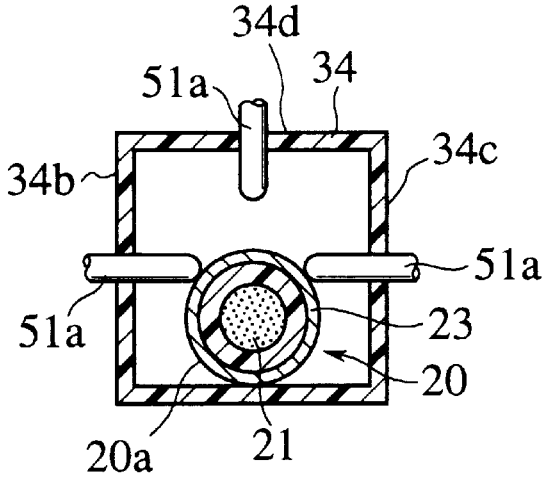
Figure 6C:
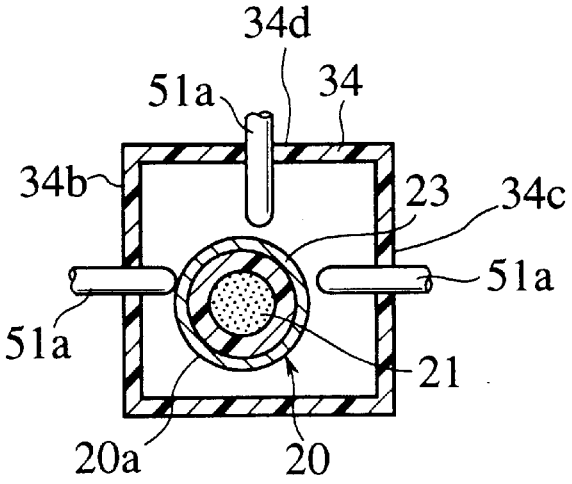

FIG. 5 shows a shielded wire connection device according to a third embodiment of the invention, and FIGS. 6A to 6C illustrate functions of the device of FIG. 5.

A shielded wire 20 has a core wire 22 terminated to a solderless terminal 25, and a terminal part 23*a* of a braid 23 stripped to be left as it is wound around an inner insulator 22. A first connector 30 comprises a housing 34 molded in a square tubular form for accommodating therein a total length of a terminal portion 20*a* of the shielded wire 20 including the solderless terminal 25 and the terminal part 23*a* of braid 23. The housing 34 of first connector 30 has left, right and upper walls 34*b*, 34*c* and 34*d* thereof crossing at right angles and formed with left, right and upper slits 35 opening at rear ends, respectively. When the solderless terminal 25 is inserted in the housing 34 to an end, the slits 35 face corresponding regions of the terminal part 23*a* of braid 23, having them exposed.

The slits 35 are formed in a longitudinal direction of the housing 34 and frontwardly extend from rear edges of the left, right and upper walls 34*b*, 34*c* and 34*d*.

A second connector 40 comprises a tubular molded housing 42, a longitudinally extending central signal terminal 41 and a triple of left, right and upper shield terminals 51. In the housing 42 is defined a terminal accommodation chamber 44 composed of a longitudinally extending main chamber 44*a* substantially square in section and a triple of longitudinally extending left, right and upper auxiliary chambers 44*b* open over lengths of their inner sides to the main chamber 44*a*.

When the first connector 30 is inserted in the second connector 40 to an end, the square housing 34 of the former 30 is entirely fitted in the main chamber 44*a* of the latter 40, and the slits 35 face rear regions of the auxiliary chambers 44*b* in a one-to-one corresponding manner.

The shield terminals 51 are respectively loose-fitted in the auxiliary chambers 44*b*, longitudinally rearwardly extending therealong to have their rear arcuate contact portions 51*a* curled inward.

When the first connector 30 is inserted in the second connector 40 to the end, the contact portions 51*a* of terminals 51 slip into the slits 35 and resiliently contact with the corresponding regions of braid 23 from outside.

The shield terminals 51 may preferably be joined at their base ends in a conductive member provided through a front wall 42*a* of the housing 42.

The signal terminal 41 is disposed at a center of the main chamber 44*a*. When the first connector 30 is entirely fitted in the main chamber 44*a*, the signal terminal 41 is inserted in the housing 34, where it mates with the solderless terminal 25, to be connected to the core wire 21.

The shielded wire 20 may be straight or curved, when installed, as circumstances require. The braid 23 may thus be deviated from a centerline of the terminal 25. Such a deviation may be left when the terminal 25 is inserted in the first connector 30, as well as when the first connector 30 is inserted in the second connector 40. Accordingly, when the contact portions 51*a* of the left, right and upper terminals 51 slip into the slits 35, the corresponding braid regions may not coincide with desirable braid regions.

In a state shown in FIG. 6A, the terminal portion 20*a* of shielded wire 20 is straight and the braid 23 is correctly centered. The contact portions 51*a* of terminals 51 all radially abut on an outer circumference of the braid 23 and are brought into contact with desirable braid regions, permitting a secured conduction.

In a state shown in FIGS. 6B or 6C, the terminal portion 20*a* is slightly curved downward or sideways and the braid 23 is deviated from the centerline of solderless terminal. The corresponding braid regions do not coincide with desirable braid regions. Still worse, some braid region is located at a distance too far for a corresponding contact portion 51*a* to reach. As a result, some contact portion 51*a* fails to radially abut on the braid 23, and some contact portion 51*a* fails to contact with the braid 23. However, the resiliently acting contact portions 51*a* are disposed at both sides and upside about the braid 23. At least one contact portion 51*a* successfully contact with the braid 23, permitting a secured conduction.

The third embodiment also permits a shielded wire 20 to be terminated with a reduced number of working steps and a reduced number of terminal fittings. In addition, a braid 23 is brought into a secured contact with a shield terminal 51 irrespective of a wiring direction of shielded wire 20, eliminating an occasional disconnection. Further, an arcuately curled contact portion 51*a* prevents a binding of braid 23, permitting a secured smooth contact without damages thereto. A lower shield terminal may preferably be provided.

Figure 7:
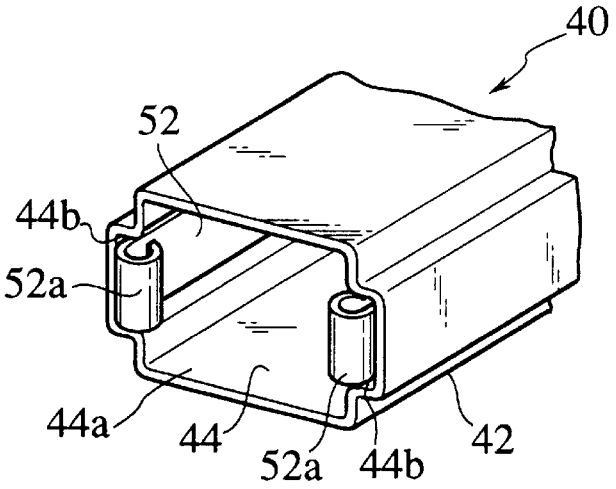
FIG. 7 is a perspective view of an essential part of a shielded wire connection device according to another embodiment of the invention.
Figure 8A:
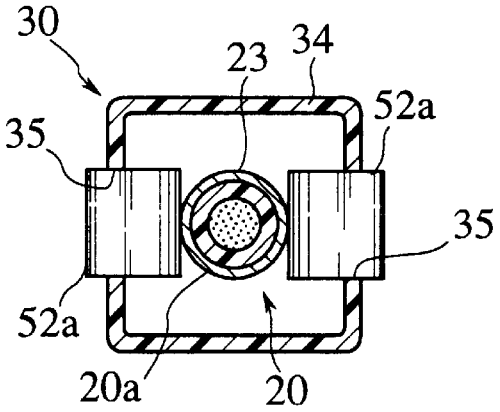
FIGS. 8A and 8B illustrate functions of the device of FIG. 7.
Figure 8B:
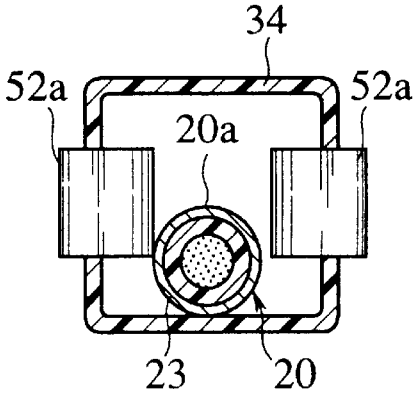

FIG. 7 shows a rear portion of a second connector 40 of a shielded wire connection device according to a fourth embodiment of the invention, and FIGS. 8A and 8B illustrate functions of the device of FIG. 7. The fourth embodiment is analogous to the third embodiment, unless otherwise disclosed herein or in the drawings.

The second connector 40 includes a tubular molded housing 42, and a pair of relatively wide plate-like left and right shield terminals 52. In the housing 42 is defined a terminal accommodation chamber 44 composed of a main chamber 44*a* and a pair of left and right auxiliary chambers 44*b* open over lengths of their inner sides to the main chamber 44*a*.

When a first connector 30 is inserted in the second connector 40 to an end, a housing 34 of the former 30 is entirely fitted in the main chamber 44*a* of the latter 40, and relatively wide left and right slits (or slots) 35 of the former 30 face rear regions of the auxiliary chambers 44*b*.

The shield terminals 52 are respectively loose-fitted in the auxiliary chambers 44*b*, longitudinally rearwardly extending therealong to have their rear arcuate contact portions 52*a* curled inward.

When the first connector 30 is inserted in the second connector 40 to the end, the contact portions 52*a* of terminals 52 slip into the slits 35 and resiliently contact with corresponding regions of a braid 23 from outside.

The shield terminals 52 may preferably be joined together at their base ends.

In a state shown in FIG. 8A, the terminal portion 20*a* of shielded wire 20 is straight and the braid 23 is correctly centered. A relatively large vertical width of each resiliently acting contact portion 52*a* allows for a wide contact area with the braid 23, permitting a secured contact.

In a state shown in FIG. 8B, the terminal portion 20*a* is slightly curved and the braid 23 is deviated from a centerline of a solderless terminal. However, the left and right contact portions 52*a* are both wide so that at least either is brought into a secured contact with the braid 23, permitting a successful conduction. In other words, such a deviation is absorbed by the width of each contact portion 52*a*.

Figure 9:
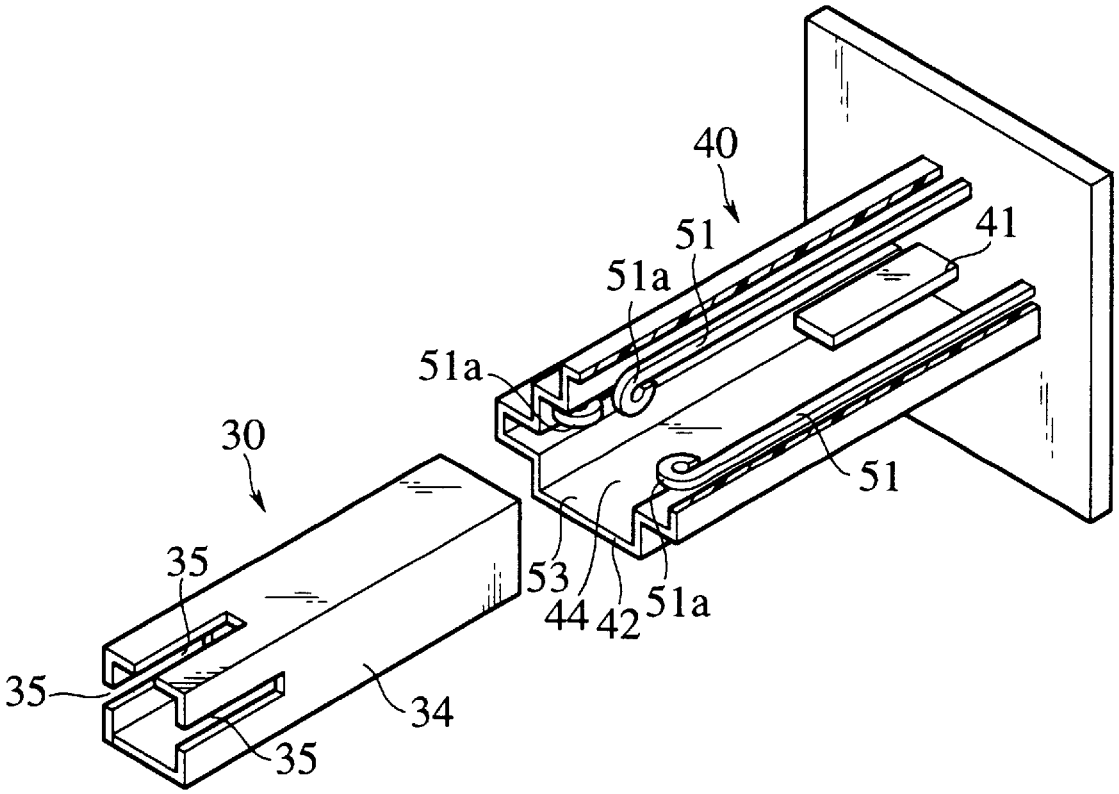
FIG. 9 is an exploded view of a shielded wire connection device according to another embodiment of the invention.
Figure 10A:
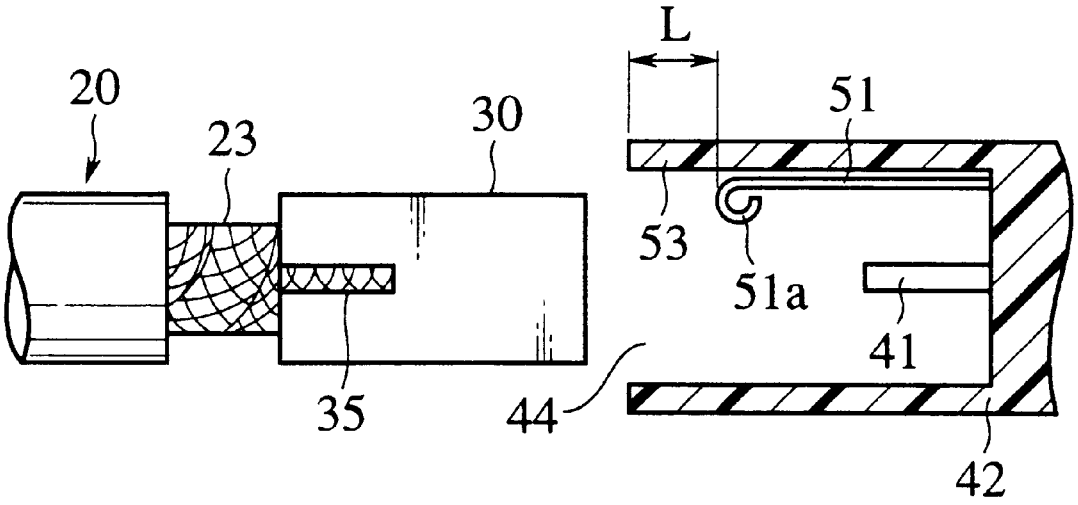
FIGS. 10A and 10B illustrate functions of the device of FIG. 9.
Figure 10B:
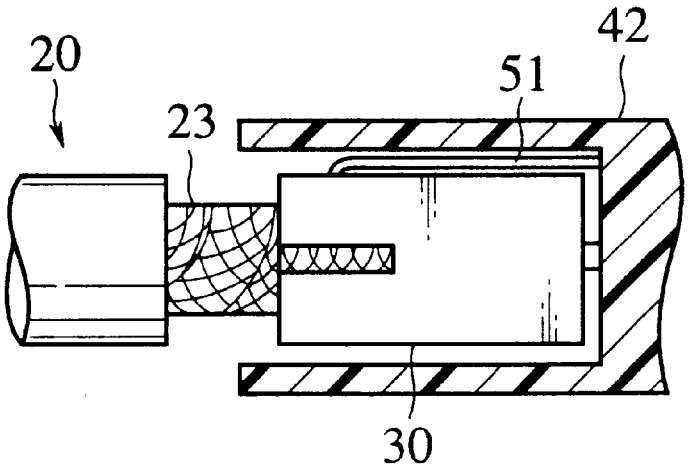

FIG. 9 shows a first connector 30 and a second connector 40 of a shielded wire connection device according to a fifth embodiment of the invention, and FIGS. 10A and 10B illustrate functions of the device of FIG. 9. The fifth embodiment is analogous to the third embodiment, unless otherwise disclosed herein or in the drawings.

In the fifth embodiment, a housing 42 of the second connector 40 has a guide part 53 for guiding the first connector 30 to be inserted to a terminal accommodation chamber 44 in the housing 42. The guide part 53 is formed as a straight rearward extension of a terminal accommodating portion of the housing 42. The extension has a preset adequate length L.

The rearwardly extending guide part 53 facilitates an insertion of the first connector 30. For the insertion, a front end of the connector 30 is first brought into a mating contact with the guide part 53, whereby it is guided to be centered to the accommodation chamber 44. With a simple additional push, an entirety of the first connector 30 is fitted inside the second connector 40, as shown in FIG. 10B, where a respective shield terminal 51 has its contact portion 51*a* slipped into a corresponding slit 35, resiliently contacting with a braid 23.

The guide part 53 may preferably have a partially reduced port for a secured positioning. In the embodiment, a flat straight bottom wall of the housing 42 allows the first connector 30 to be straightly inserted all the way into the accommodation chamber 44, permitting a smooth and accurate mating. If the guide part 53 were removed from this embodiment, the front end of the first connector 30 might have a spacing left thereunder, when entering the accommodation chamber 44, where it might have pushed down been by the contact portion 51*a* of upper shield terminal 51, with a thump against the bottom wall of the housing 42.

While preferred embodiments of the present invention have been described using specific terms, such description is for illustrative purposes, and it is to be understood that changes and variations may be made without departing from the spirit or scope of the following claims.

What is claimed is:

1. A connection device for connecting a shielded wire to a combination of a signal line and a shield line, the shielded wire having a stripped terminal portion including a braid wound around an inner insulator put on a core wire and a terminal member attached to the core wire, the connection device comprising:

an insulating first housing for having the terminal portion of the shielded wire inserted therein;

an insulating second housing for having the first housing inserted therein;

a first terminal contacting at one end thereof with the terminal member and connected at another end thereof to the signal line, the first terminal being provided through the first and the second housing; and a second terminal contacting at one end thereof with the braid and connected at another end thereof to the shield line, the second terminal being provided through the second housing and extending between the first and the second housing.

2. A connection device according to claim 1, wherein the second terminal has a contact part resiliently contacting with a circumferential region of the braid.

3. A connection device according to claim 2, wherein:

the second terminal has a bent part disposed outside the first housing for providing an increased resiliency to the contact part.

4. A connection device according to claim 3, wherein the second housing is formed with an opening facing the bent part of the second terminal.

5. A connection device according to claim 2, wherein the circumferential region of the braid is exposed outside the first housing.

6. A connection device according to claim 2, wherein the first housing is formed with a slit for having the contact part of the second terminal slip therein to contact with the circumferential region of the braid.

7. A connection device according to claim 6, wherein:

the first housing has a pair of said slits formed either in two of four lateral sides thereof opposing each other;

the connection device has a pair of said contact parts disposed either on the two lateral sides of the first housing; and the pair of contact parts each have a contact surface extending in a tangential direction of the circumferential region of the braid.

8. A connection device according to claim 6, wherein:

the first housing has a triple of said slits formed any in three of four lateral sides thereof; and the connection device has a triple of said contact parts disposed any on the three lateral sides of the first housing.

9. A connection device according to claim 2, wherein the second housing has a guide part for guiding the first housing to be inserted therein.

10. A connection device according to claim 9, wherein the guide part comprises an extension of the second housing extending past the contact part of the second terminal.

11. A connection device according to claim 2, wherein the contact part has an arcuate contact surface.

12. A connection device according to claim 1, wherein said second terminal is a one-piece terminal.

* * * * *

UNITED STATES PATENT AND TRADEMARK OFFICE

CERTIFICATE OF CORRECTION

PATENT NO. : 5,931,698

DATED : August 3, 1999

INVENTOR(S): Shinji KODAMA

It is certified that an error appears in the above-identified patent and that said Letters Patent is hereby corrected as shown below:

Column 1, Line 48, change "interconneciton" to --interconnection--;
Line 50, insert --The-- before "Number"; same line, change "Number" to --number--;
Line 56, insert --is-- after "and".

Column 3, Line 13, insert --to-- after "According";
Line 35, change "any on" to --on any of--.

Column 9, Line 4, insert --been-- after "have";
Line 5, delete "been" at beginning of line.

Signed and Sealed this

Sixteenth Day of January, 2001

*Attest:*

Q. TODD DICKINSON

*Attesting Officer*

*Commissioner of Patents and Trademarks*